United States Patent [19]

Terauchi

[11] Patent Number: 4,575,319

[45] Date of Patent: Mar. 11, 1986

[54] METHOD AND APPARATUS FOR ADJUSTING THE ANGULAR RELATIONSHIP OF SPIRAL ELEMENTS IN A SCROLL TYPE FLUID DISPLACEMENT APPARATUS

[75] Inventor: Kiyoshi Terauchi, Isesaki, Japan

[73] Assignee: Sanden Corporation, Gunma, Japan

[21] Appl. No.: 636,670

[22] Filed: Aug. 1, 1984

[51] Int. Cl.[4] ..... F01C 1/04; F01C 19/00; B23P 15/00

[52] U.S. Cl. ..... 418/55; 418/57; 418/107; 29/156.4 R; 29/434

[58] Field of Search ..... 418/55, 57, 107–109; 29/156.4 R, 434, 464

[56] References Cited

U.S. PATENT DOCUMENTS 801,182 10/1905 Creux ..... 418/55
3,924,977 12/1975 McCullough ..... 418/57

FOREIGN PATENT DOCUMENTS 217021 5/1958 Australia ..... 418/108
57-193793 11/1982 Japan ..... 29/156.4 R
59-15691 1/1984 Japan .

*Primary Examiner*—John J. Vrablik
*Attorney, Agent, or Firm*—Banner, Birch, McKie & Beckett

[57] ABSTRACT

A method and apparatus for adjusting the angular relationship between the scroll elements of a scroll type fluid displacement apparatus are disclosed. Holes are provided in the front end plate of the apparatus housing and the end plate of the orbiting scroll member. An adjusting member is inserted through these holes and is received in a bore provided in the fixed scroll member. The front end plate then is rotated in the reverse direction (opposite the drive direction) of the apparatus until its movement is stopped. The apparatus drive shaft then is rotated in the drive direction in order to establish the proper angular relationship between the scroll members. While the drive shaft is being rotated, the front end plate is secured to the housing in order to maintain the desired angular relationship.

6 Claims, 4 Drawing Figures

METHOD AND APPARATUS FOR ADJUSTING THE ANGULAR RELATIONSHIP OF SPIRAL ELEMENTS IN A SCROLL TYPE FLUID DISPLACEMENT APPARATUS

BACKGROUND OF THE INVENTION

This invention relates generally to the field of fluid displacement apparatus, and more particularly, is directed to a method and apparatus for adjusting the angular relationship between the spiral elements of a scroll type fluid displacement apparatus.

Scroll type fluid displacement apparatus are well known in the prior art. For example, U.S. Pat. No. 801,182 (Creux) discloses such a device which includes two scroll members each having a circular end plate and a spiroidal or involute spiral element. The scroll members are maintained angularly and radially offset so that both spiral elements interfit to form a plurality of line contacts between their spiral curved surfaces to thereby seal off and define at least one pair of fluid pockets. The relative oribtal motion of the scroll members shifts the line contacts along the spiral curved surfaces and, therefore, the fluid pockets change in volume. since the volume of the fluid pockets increases or decreases dependent on the direction of the orbiting motion, a scroll type fluid displacement apparatus is applicable for compressing, expanding or pumping fluids.

In comparison with conventional compressors of the piston type, the scroll type compressor has certain advantages, such as fewer parts and continuous compression of fluid. Scroll type compressors known in the prior art, however, have the disadvantage that proper adjustment of the angular relationship between the spiral elements is difficult to achieve and maintain. If the angular relationship is not correct, the radial contact points between the spiral elements are not tightly sealed, thereby permitting fluid leakage. As a result, the efficiency of the compressor is significantly reduced.

One solution to the problem of achieving the proper angular relationship between the scroll elements is to reduce the permissible manufacturing tolerances of the component parts. The manufacture of scroll compressor components, however, is already complicated and reducing tolerances would greatly increase manufacturing costs. Another proposed solution is to increase the tolerance of the angular relationship between the spiral elements. Such a solution also has not proved satisfactory.

During the assembly of a scroll type compressor having a ball coupling mechanism, the relative angular relationship between the two scroll members is controlled by the following factors;

(1) the relative angular offset between the fixed scroll elements and the housing;

(2) the relative angular offset between the housing and the front end plate of the housing;

(3) the relative angular offset between the front end plate of the housing and the fixed ring of the ball coupling mechanism;

(4) the relative angular offset caused by the difference between the inner diameter of the hole formed in the fixed ring of the ball coupling mechanism and the outer diameter of the ball;

(5) the relative angular offset caused by the difference between the outer diameter of the ball and the inner diameter of the hole formed in the movable ring of the ball coupling mechanism; and (6) the relative angular offset between the movable ring of the ball coupling mechanism and the orbiting scroll member.

In order to accomodate these factors, one technique to establish the proper angular relationship between the scroll members is to provide a first hole in the end wall surface of the spiral element of one scroll member and a second hole through the front end plate opposite to the first hole formed in the scroll member. Proper adjustment of the relationship between both scroll members is established by inserting an angle adjusting member through both holes from the outside of the front end plate.

While the above technique may be effective with respect to factors 1–3 listed above, it has not proved effective with respect to factors 4–6.

SUMMARY OF THE INVENTION

It is the overall object of the present invention to provide an efficient scroll type fluid displacement apparatus.

It is specific object of the present invention to provide a scroll type fluid displacement apparatus wherein the angular relationship between both scroll members can be easily and precisely established.

It is a further object of the present invention to provide an adjustment member for establishing the proper angular relationship between the scroll members of a scroll type fluid displacement apparatus.

It is another object of the present invention to provide a method for assembling a scroll type fluid displacement apparatus wherein the proper angular relationship between the scroll members may be established.

It is another specific object of the present invention to achieve the above objects using simple construction and assembly techniques.

A scroll type fluid displacement apparatus according to the present invention includes a housing having a front end plate and a pair of scroll members. One of the scroll members is fixedly disposed relative to the housing and has an end plate from which a first wrap extends into the interior of the housing. The other scroll member is movably disposed for non-rotative orbital movement within the interior of the housing and has an end plate from which a second wrap extends. The first and second wraps interfit at an angular and radial offset to form a plurality of line contacts to define at least one pair of sealed off fluid pockets. A driving mechanism is operatively connected to the orbiting scroll member to effect its orbital motion, whereby the fluid pockets move and change volume. The fixed scroll member is formed with a bore which has a predetermined depth and the front end plate of the housing is formed with a hole extending completely through it. A hole is also provided in the end plate of the oribiting scroll member. The holes are then aligned with the bore by an adjustment member. The adjustment member extends through the holes into the bore during assembly of the apparatus to establish the proper angular relationship between the two scroll members. The present invention also is directed to a method for assembling the scroll type fluid displacement apparatus.

Further objects, features and other aspects of this invention will be understood from the detailed description of the preferred embodiments with reference to the annexed drawings.

DETAILED DESCRIPTION OF PREFERRED EMBODIMENTS

Figure 1:
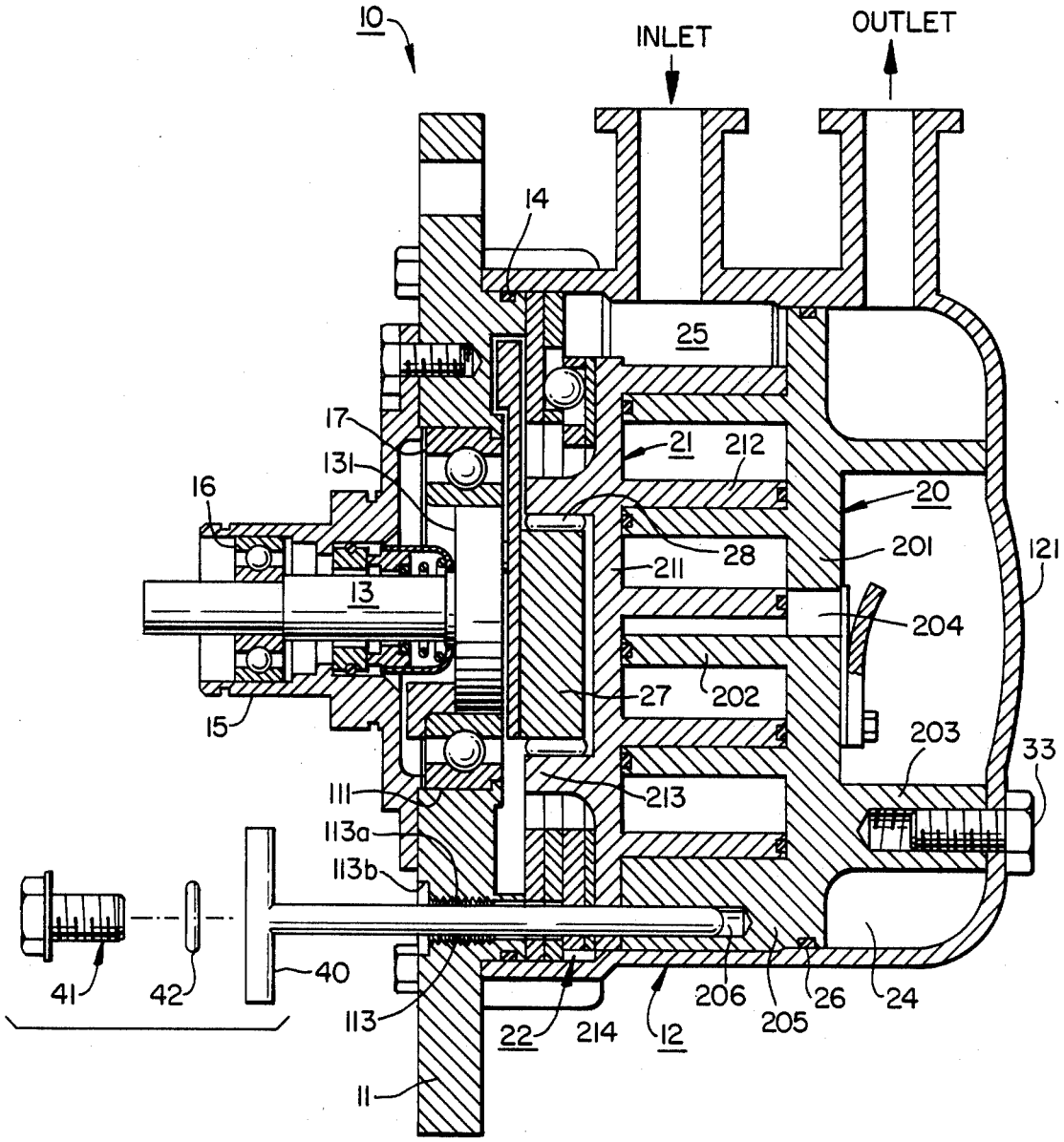
FIG. 1 is a vertical sectional view of a scroll type fluid displacement apparatus according to one embodiment of the present invention.

Referring to FIG. 1, an embodiment of a scroll type fluid displacement apparatus in accordance with the present invention is shown. The apparatus, which preferably is a scroll type compressor, includes compressor housing 10 having front end plate 11 and cup shaped casing 12 fastened on the rear end surface of front end plate 11. Opening 111 is formed in the center of front end plate 11 for penetration or passage of drive shaft 13. The open portion of cup shaped casing 12 is covered by front end plate 11. The mating surface between front end plate 11 and cup shaped casing 12 is sealed by O-ring 14. Front end plate 11 has angular sleeve 15 projecting from the front end surface thereof which surrounds drive shaft 13 to define a shaft seal cavity.

Drive shaft 13 is rotably supported by sleeve 15 through bearing 16 located within the front end of sleeve 15. Drive shaft 13 has disk shaped rotor 131 at its inner end which is rotably supported by front end plate 11 through bearing 17 located within opening 111 of front end plate 11.

A number of elements are disposed within the interior of cup shaped casing 12 including fixed scroll 20, orbiting scroll 21, a driving mechanism for orbiting scroll 21 and rotation preventing/thrust bearing mechanism 22 for orbiting scroll 21. The interior of cup shaped casing 12 is defined by its inner wall and the rear end surface of front end plate 11.

Fixed scroll 20 includes circular end plate 201, wrap or spiral element 202 affixed to or extending from one side surface of circular end plate 201 and a plurality of internally threaded bosses 203 axially projecting from the other side surface of circular end plate 201. An axial end surface of each boss 203 is seated on the inner surface of end plate 121 of cup shaped casing 12 and is fixed to end plate 121 by bolts 23. Fixed scroll 20 is thus fixed within cup shaped casing 12. Circular end plate 201 of fixed scroll 20 partitions the inner chamber of cup shaped casing 12 into two chambers, i.e., discharge chamber 24 having bosses 203 and suction chamber 25 in which spiral element 202 is located. Seal ring 26 is placed between the outer peripheral surface of circular end plate 201 of fixed scroll 20 at a position near the center of spiral element 202. Hole 204 connects the fluid pocket at the center of the spiral elements to discharge chamber 24.

Orbiting scroll 21, which is disposed in suction chamber 25, comprises circular end plate 211 and wrap or spiral element 212 affixed to or extending from one side surface of end plate 211. Spiral element 212 of orbiting scroll 21 and spiral element 202 of fixed scroll 20 interfit at an angular offset of 180° and a predetermined radial offset to form a plurality of line contacts. Therefore, at least one pair of sealed off fluid pockets are defined between spiral elements 202 and 212. Orbiting scroll 21 is connected to driving means and rotation preventing/-thrust bearing means 22. The drive means via rotation preventing/thrust bearing means 22 effect the orbital motion of orbiting scroll 21 by the rotation of drive shaft 13.

Figure 2:
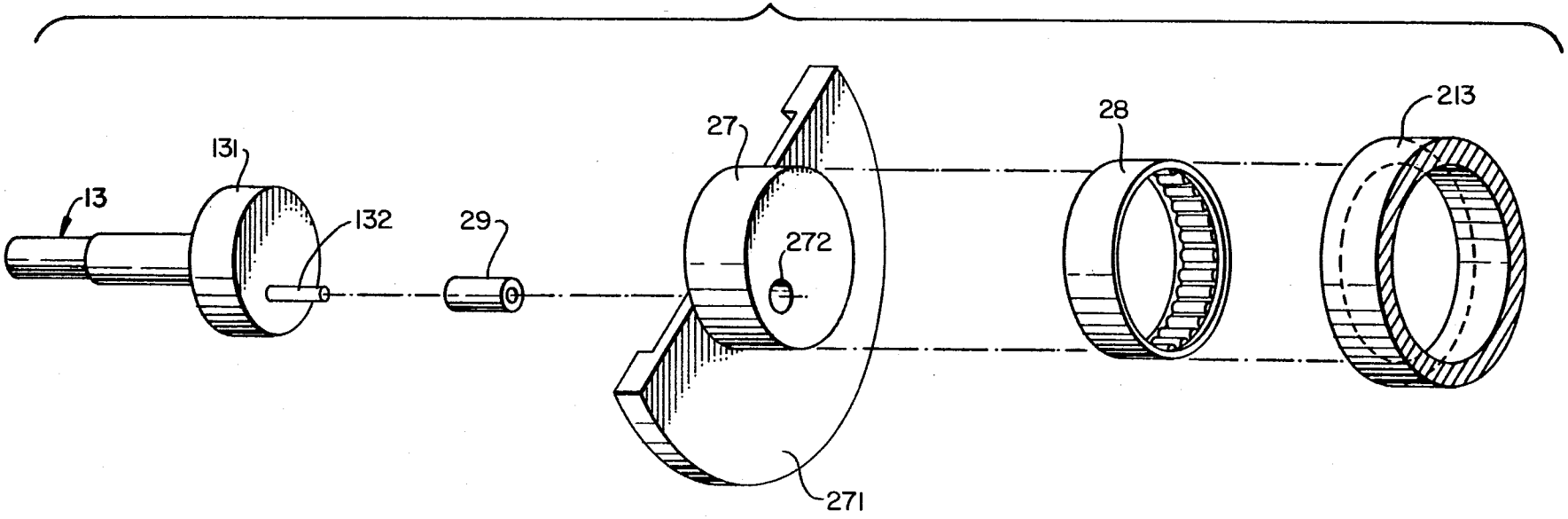
FIG. 2 is an exploded perspective view of a driving mechanism for an orbiting scroll used in the apparatus of FIG. 1.

Referring to FIGS. 1 and 2, the drive mechanism for orbiting scroll 21 will be described. Drive shaft 13 is formed with disk shape portion 131 at its inner end and is rotatably supported by bearing 16 disposed within sleeve 15. Crank pin or drive pin 132 projects axially from an end surface of disk portion 131 and is radially offset from the center of drive shaft 13. Circular end plate 211 of orbiting scroll 21 is provided with tubular boss 213 axially projecting from an end surface opposite to the side thereof from which spiral element 212 extends. Axial bushing 27 is fitted into boss 213 and is rotatably supported therein by needle bearing 28. Bushing 27 has balance weight 271 (see FIG. 2) which is shaped as a portion of a disk or ring and extends radially outward from bushing 27 along a front surface thereof. Eccentric hole 272 is formed in bushing 27 radially offset from the center of bushing 27. Drive pin 132 is fitted into hole 272 within which bearing 29 may be inserted. Bushing 27 is therefore driven by the rotation of drive pin 132 and is permitted to rotate by needle bearing 28 compliantly driving orbiting scroll 21 so that it follows the contour of fixed scroll 20.

Figure 3:
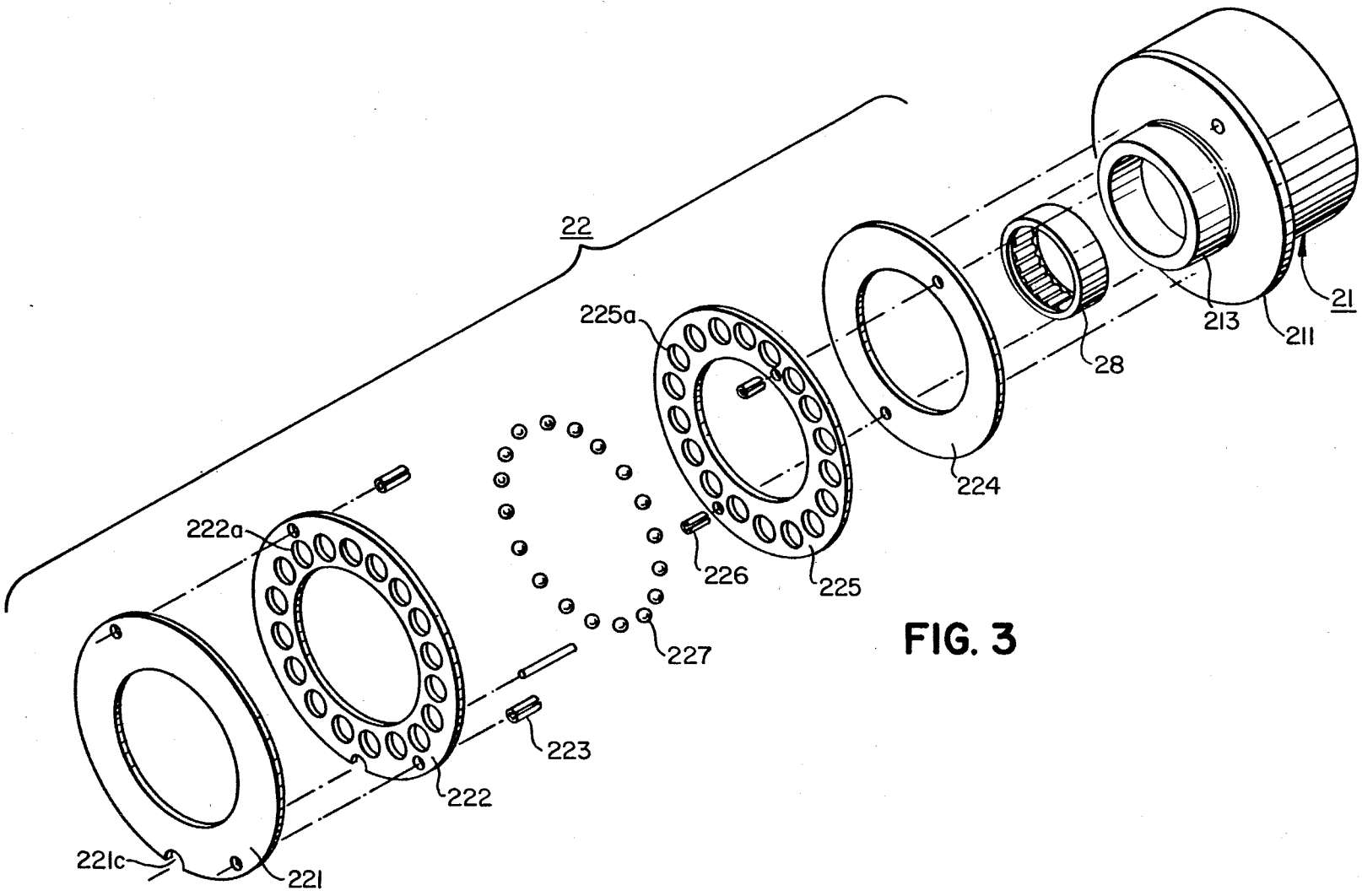
FIG. 3 is an exploded perspective view of a rotation preventing/thrust bearing mechanism for an orbiting scroll used in the apparatus of FIG. 1.

Referring to FIG. 3, rotation preventing/thrust bearing device 22 will be described. Rotation preventing/-thrust bearing device 22 is disposed between the rear end surface of circular end plate 211 of orbiting scroll 21 on the side opposite spiral element 212. Rotation preventing/thrust bearing device 22 includes a fixed portion, an orbital portion and a bearing element, such as a plurality of spherical balls. As shown in FIG. 3, the fixed portion includes annular fixed race 221, having one end surface fixed against the axial end surface of an annular projection formed on front end plate 11, and fixed ring 222 fixed against the other axial end surface of fixed race 221. Fixed race 221 and fixed ring 222 are attached to the annular projection on front end plate 11 by pins 223.

The orbital portion of rotation preventing/thrust bearing device 22 includes annular orbital race 224, which has one end surface fitted against an axial end surface of circular end plate 211, and orbital ring 225 fitted against the other axial end surface of orbital race 224. Orbital race 224 and orbital ring 225 are attached to the end surface of circular end plate 211 by pins 226. Alternatively, rings 222, 225 may be formed integral with races 221, 224, respectively.

Fixed ring 222 and orbital ring 225 each have a plurality of holes or pockets **222*a* and 225*a* in the axial direction, the number of holes or pockets in each ring being equal. Holes 222*a* on fixed ring 222 correspond to or are a mirror image of holes 225*a* on orbital ring 225, i.e., the pair of holes facing each other have the same size and pitch. The radial distance of the holes from the center of their respective rings is also the same. Thus, if the centers of rings 222 and 225 were aligned, which they are not in actual operation of rotation preventing/-thrust bearing device 22, the holes would also be in alignment. Bearing elements, such as balls 227, are placed between generally aligned pairs of holes 222***a* and 225*a* of fixed and orbital rings 222, 225 with the rings facing each other at a predetermined clearance.

Figure 4:
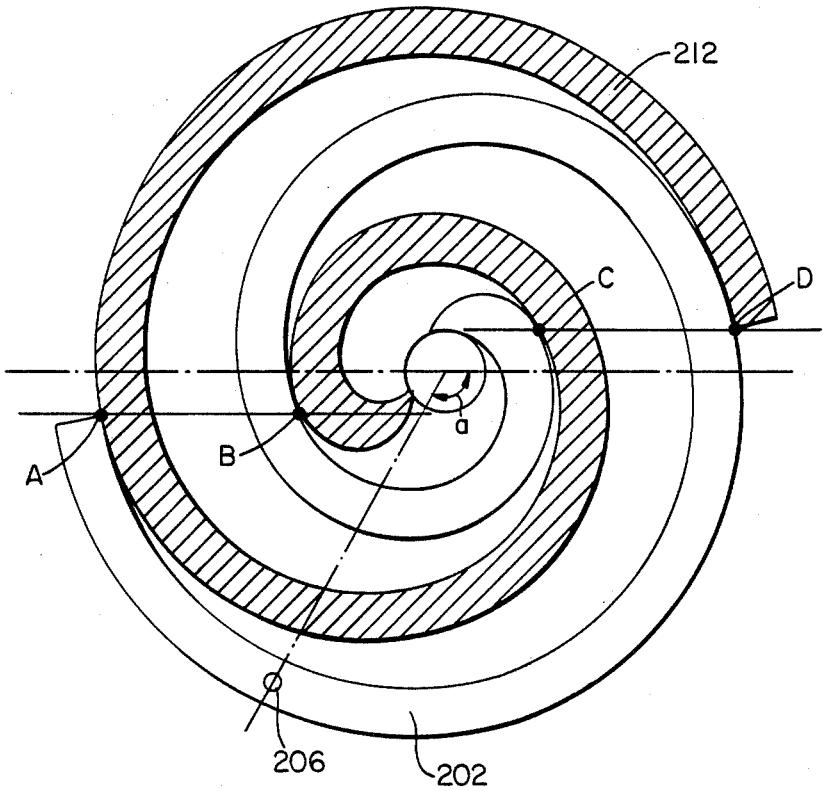
FIG. 4 is a diagramatic view of a fixed scroll illustrating the position of the hole which receives the adjusting member.

With reference to FIG. 1 again, fixed scroll 20 is provided with projection 205 formed on the outer surface of spiral element 202, and is preferably formed integral with it. Round bore 206, which has a predetermined depth, is formed in projection 205 of fixed scroll 20. As shown in FIG. 4, round bore 206 is placed on a line drawn through the center of the circle generated by the spiral elements at a predetermined angle relative to a line drawn through a plurality of line contacts A, B, (or C, D) between spiral elements 202 and 212. Circular end plate 211 of orbiting scroll 21 is formed with hole 214 and front end plate 11 is formed with hole 113. Hole 113 is positioned in alignment with bore 206 and hole 214 in a manner described hereinafter. Hole 113 has a diameter larger than the diameter of bore 206 and hole 214.

Assembly of the compressor in accordance with the present invention is accomplished in the following manner. Fixed scroll 20 is secured within the interior of cup shaped casing 12 by bolts 23. Orbiting scroll 21, with orbital ring 225 and orbital race 224 attached to end plate 211 and needle bearing 28 carrying bushing 27 engaging tubular boss 213, is then inserted within cup shaped casing 12 as shown in FIG. 1. Balls 227 may then be placed in holes 225*a* of orbital ring 225. The driving mechanism for orbiting scroll 21 and annular fixed race 221 and fixed ring 222 of rotation preventing/thrust bearing device 22 are assembled on front end plate 11 along with angular sleeve 15 and drive shaft 13. As shown in FIG. 2, drive shaft 13 also includes disk shaped rotor 131 with crank pin 132. Crank pin 132 engages bearing 29 which in turn engages hole 272 formed in bushing 27. Front end plate 11 then is placed over and in engagement with the open portion of cup shaped casing 12. Prior to end plate 11 being secured in place, adjustment member 40 (see FIG. 1) is inserted through hole 113 and hole 214 into bore 206 to bring holes 113 and 214 into alignment with bore 206.

After adjustment member 40 is inserted, front end plate 11 is rotated slightly in the reverse direction (opposite the drive direction) of the apparatus to secure the interaction of balls 227 between facing holes 222*a* and 225*a*. There is some play between adjustment member 40, holes 113 and 214 and bore 206. Thus, end plate 11 may be rotated slightly back and forth. Because during the operation of the apparatus, balls 227 of rotation preventing/thrust bearing device 22 usually interact between the edges of holes 222*a* and 225*a*, without a gap, to prevent the rotation of orbiting scroll 21, the proper angular relationship between fixed scroll 20 and orbiting scroll 21 then can be established. Drive shaft 13 then is rotated in the drive direction of the apparatus to push spiral element 212 of orbiting scroll 21 against spiral element 202 of fixed scroll 20. During this operation, orbiting scroll 21 is able to move around adjustment member 40. Therefore, after spiral element 212 is fitted against spiral element 202 of fixed scroll 20, orbiting scroll 21 is further rotated around adjustment member 40 by rotation of the drive shaft. Because orbiting ring 225 is fixed on end plate 211 of orbiting scroll 21, orbiting ring 225 is rotated around adjustment member 40 due to the rotating motion of orbiting scroll 21. Since ball 227 of rotation preventing/thrust bearing mechanism 22 is securely held between the edges of both holes 222*a* and 225*a*, fixed ring 222, together with front end plate 11, is rotated in the drive direction following the rotation of orbiting scroll 21. Thus, the proper relationship between both scrolls 20, 21 and rotation preventing mechanism 22 and orbiting scroll 21 can be established for ideal operation of the scroll. After the proper relationship is established, end plate 11 can be secured to cup shaped casing 12.

The angular relationship between both scrolls can therefore be adjusted and set by the above mentioned method. After the angular relationship between the scroll elements is set, adjustment member 40 is removed from the apparatus and plug 41 is screwed into screw portion 113*a* of hole 113. Seal ring 42 then is disposed within annular depression 113*b* formed at an end portion of hole 113 to seal off the inner chamber of cup shaped casing 12.

This invention has been described in detail in connection with a preferred embodiment, but this embodiment is merely for example only and this invention is not restricted thereto. It will be easily understood by those skilled in the art that other variations and modifications can be easily made within the scope of this invention, as defined by the appended claims.

I claim:

1. In a scroll type fluid displacement apparatus including a housing having a front end plate, a fixed scroll member disposed relative to said housing and having a first end plate from which a first spiral element extends, an orbiting scroll member having a second end plate from which a second spiral element extends, said orbiting scroll member being disposed within said housing and interfitting with said fixed scroll member at an angular and radial offset to make a plurality of line contacts to define at least one pair of sealed off fluid pockets a driving mechanism operatively connected to said orbiting scroll member to effect the orbital motion of said orbiting scroll member, a rotation preventing/-thrust bearing mechanism operatively connected to said driving mechanism and said orbiting scroll member to prevent rotation of said orbiting scroll member during orbital motion, said rotation preventing/thrust bearing mechanism including a fixed ring connected to said fixed scroll member and an orbiting ring connected to said orbiting scroll member, said fixed and orbiting rings being formed with a plurality of holes which receive a corresponding plurality of ball elements, the improvement comprising:

said fixed scroll member having a bore of predetermined depth;

said second end plate having a hole adjacent said bore;

said front end plate having a hole adjacent said hole in said second end plate, the combination of said hole in said front end plate, said hole in said second end plate and said bore being capable of receiving an adjusting member with an elongated portion during assembly of said scroll type fluid displacement apparatus so that said holes can be brought into substantial alignment with said bore by the elongated portion of said adjusting member to establish a predetermined angular relationship between said fixed and orbiting scroll members, wherein said plurality of ball elements are held adjacent the edges of said plurality of holes formed in said fixed and orbiting rings.

2. The scroll type fluid displacement apparatus of claim 1 wherein said bore and said hole in said second end plate have a diameter smaller than the diameter of said hole in said front end plate.

3. The scroll type fluid displacement apparatus of claim 1 wherein said hole in said second end plate is located on a line drawn through the center of the circle generated by said spiral elements at a predetermined angle with respect to a line passing through a plurality of the line contacts defined between said spiral elements.

4. In a method for assembling a scroll type fluid displacement apparatus including a housing having at least one open portion, a front end plate for said housing, said front end plate having a hole, a fixed scroll member having a first end plate from which a first spiral element extends, said first end plate having a bore of predetermined depth, an orbiting scroll member having a second end plate from which a second spiral element extends, said second end plate having hole, a cover device for said hole in said front end plate, a driving mechanism operatively connected to said orbiting scroll member to effect the orbital motion of said orbiting scroll member and a rotation preventing/thrust bearing mechanism operatively connected to said driving mechanism and said orbiting scroll member to prevent rotation of said orbiting scroll member during orbial motion, said rotation preventing/thrust bearing mechanism including a fixed ring connected to said fixed scroll member and an orbiting ring connected to said orbiting scroll member, said fixed and orbiting rings being formed with a plurality of holes which receive a corresponding plurality of ball elements, said method comprising the steps of:

securing said fixed scroll member within said housing;

operatively connecting said driving mechanism to said orbiting scroll member;

attaching said orbiting scroll member and said driving mechanism to said front end plate;

placing said front end plate over said open portion of said housing wherein said fixed scroll member and said orbiting scroll member interfit at an angular and radial offset to make a plurality of line contacts to define at least one pair of sealed off pockets;

inserting an adjusting member having an elongated portion through said holes in said front end plate and said second end plate of said orbiting scroll member into said bore in said first end plate of said fixed scroll member to substantially align said holes with said bore to thereby establish a predetermined angular relationship between said fixed and orbiting scroll members, rotating said front end plate in the direction opposite the driving direction of the apparatus wherein said plurality of ball elements are held adjacent the edges of said plurality of holes formed in said fixed and orbiting rings;

securing said front end plate to said housing; and removing said adjusting member from said hole in said front end plate, said hole in said second end plate and said bore.

5. The method of claim 4 comprising the further step of rotating said drive shaft in the driving direction of said apparatus at a predetermined torque prior to said step of securing said front end plate to said housing thereby pushing said second spiral element against said first spiral element to establish the proper relationship between both scrolls and the rotation preventing/thrust bearing mechanism 6. The method of claim 4 comprising the further step of covering said holes with said cover device.

* * * * *